US005926956A

United States Patent [19]

Langman et al.

[11] Patent Number: 5,926,956

[45] Date of Patent: Jul. 27, 1999

[54] COMBINATION FINGER AND TOE NAIL CLIPPERS

[75] Inventors: Kirk Langman, Los Angeles; Michael Greene, Sherman Oaks; Kenneth Tarlow, Corte Madera, all of Calif.

[73] Assignee: Kirk Langman, Los Angeles, Calif.

[21] Appl. No.: 09/019,335

[22] Filed: Feb. 5, 1998

Related U.S. Application Data

[63] Continuation-in-part of application No. 08/873,255, Jun. 11, 1997, Pat. No. 5,806,186.

[51] Int. Cl.[6] ..... A45D 29/02

[52] U.S. Cl. ..... 30/28; 132/75.5

[58] Field of Search ..... 30/28; 132/73.5, 132/75.4

[56] References Cited

U.S. PATENT DOCUMENTS

| | | | |
|---|---|---|---|
| 2,999,505 | 9/1961 | Herstedt | 30/28 |
| 3,315,354 | 4/1967 | Oates | 30/28 |
| 4,176,449 | 12/1979 | Lee et al. | 30/28 |
| 5,806,186 | 9/1998 | Langman et al. | 30/28 |

*Primary Examiner*—Douglas D. Watts
*Attorney, Agent, or Firm*—Lawrence S. Cohen, Esq.

[57] ABSTRACT

A combined toe and finger nail clipper having a common metal strip with a toe nail cutting edge at one end and a finger nail cutting edge at the opposite end. Mating nail cutting edges are at the ends of two additional metal strips which are each welded above and below at opposite ends of the common metal strip. A pair of vertical retaining posts located at each end of the nail clipping unit hold lever arms which can be stored in the flat position or rotated around and put into the use position as in conventional nail clippers. In this way a manufacturer can produce a combined toe and finger nail clipper more economically than two separate nail clippers and the user can store the combined nail clipper in a smaller space without worrying about locating two separate clippers. The clipper can be constructed so that while one of the clippers is in use the cutting edges of its other are closed or only slightly open so as to avoid the corners of the cutting edges catching or scratching a finger of the user.

4 Claims, 2 Drawing Sheets

FIG. 1
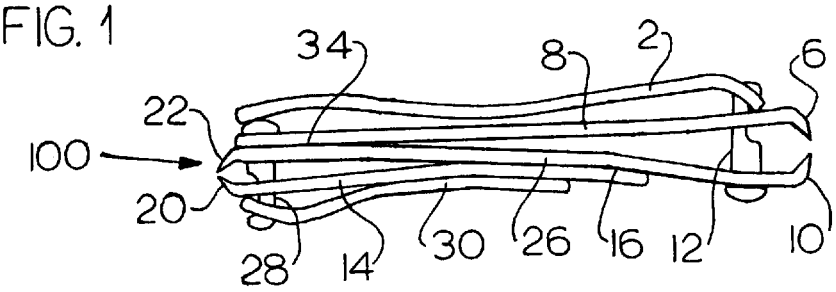
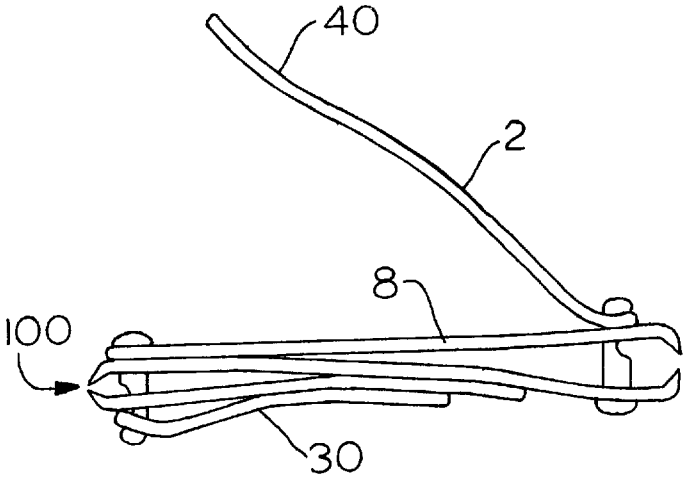
FIG. 2
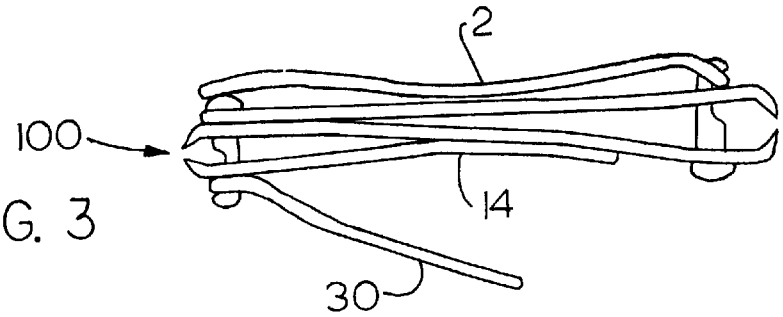
FIG. 3

FIG. 4
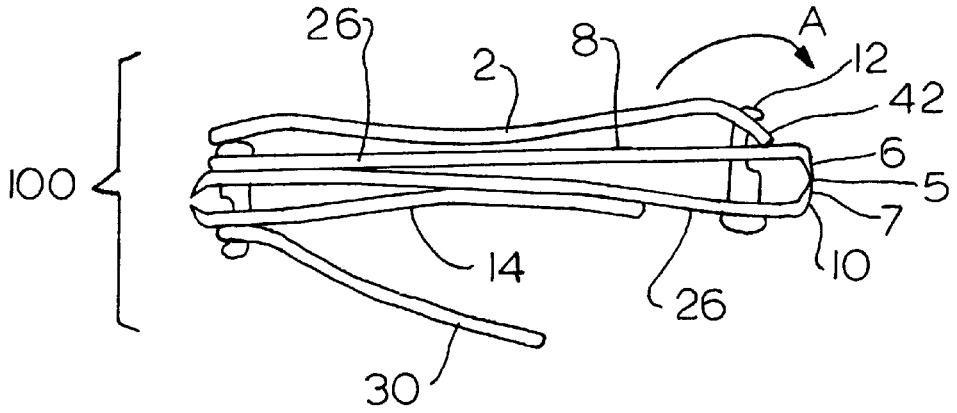
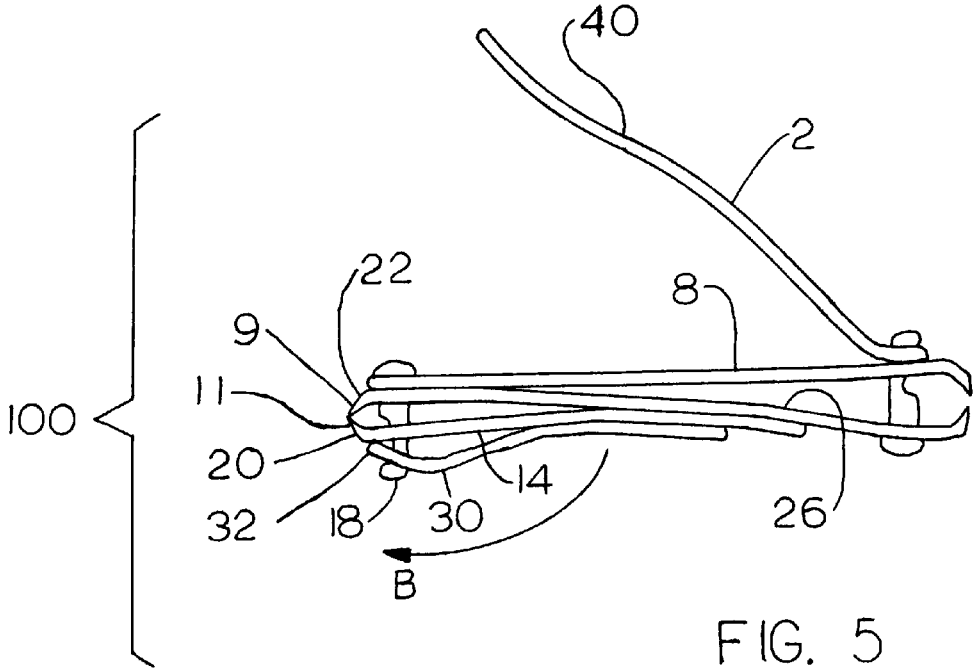
FIG. 5

COMBINATION FINGER AND TOE NAIL CLIPPERS

CROSS-NOTING TO PRIOR APPLICATION

This is a continuation in part of prior application Ser. No. 08/873,255 filed on Jun. 11, 1997, now U.S. Pat. No. 5,806,186 the context of which is incorporated herein by reference.

FIELD OF INVENTION

The present invention relates to nail clippers and more specifically to a combination toe nail and finger nail clipper.

BACKGROUND OF INVENTION

Nail clippers in a variety of designs have been in existence for many years. Nail clippers of different sizes with different size cutting heads have been developed for both toe nails and finger nails. Since toe nails, especially the big toe, tend to be larger than finger nails, a larger clipper has been developed for toe nails whereas a smaller clipper is commonly used for finger nails. Many people are forced to purchase, own and keep track of two nail clippers. It would appear that there is a need for a single nail clipper which performs both functions of a toe nail clipper and a finger nail clipper and is less expensive to manufacture than two separate nail clippers.

OBJECT AND SUMMARY OF THE PRESENT INVENTION

It is the object of the present invention to solve the above stated problem by providing a single nail clipper which has a toe nail cutting head at one end and a finger nail cutting head at the opposite end. This is accomplished by providing a sharpened nail cutting edge at either end of a first flat metal strip. A small finger nail clipping cutting edge is at one end and a larger toe nail cutting edge is at the opposite end. A second metal strip is welded at one end to the first metal strip. The second metal strip has a toe nail cutting edge at the opposite end. The first and second strip form a V shape with the bottom of the V being the welded end and the top of the V being the toe nail cutting end where the toe nail cutting edges face each other. A third metal strip is welded to the first metal strip on the opposite side to the second metal strip. This third strip has a finger nail cutting edge at one end and faces a mating finger nail cutting edge located at one end of the first metal strip. Vertical posts are located at each end of the nail clipping assembly and a swingable lever like arm is fastened to each vertical post and operate in typical nail clipper fashion where in one position the lever arm lays flat against the main body of the clipper and when swung and flipped forms a lever arm for applying pressure to the free moving cutting blade. In this way the present invention provides a new and improved nail clipping device which combines a toe nail clipper and a finger nail clipper which can be manufactured more economically than two separate nail clippers and which also is more convenient for a person to store and use. The drawings below show a detailed description of the preferred embodiment, however, it is to be understood that there may be other embodiments which differ somewhat from the preferred embodiment but which, never the less, are embodied within the spirit of the present invention and would be obvious to one versed in the stated of the art.

In another aspect the lever arms have extensions so that in the not in use position bias adjacent clipping surfaces are biased together to be touching or only slightly separated so as to avoid, scratching or catching the user.

BRIEF DESCRIPTION OF THE DRAWINGS

FIG. 1 is a side view of the nail clippers of the present invention in the non-use position.

FIG. 2 is a side view of the nail clippers of the present invention with the toe nail clipper portion in the use position.

FIG. 3 is a side view of the nail clippers of the present invention with the finger nail clipper portion in the use position.

FIG. 4 is a side view of the nail clippers of the present inventor showing the finger nail clipper in the use position and the toe nail clipping surfaces closed.

FIG. 5 is side view of the present invention showing the toe nail clippers in the use position and the finger nail clipping surfaces closed.

DETAILED DESCRIPTION

Referring now to FIG. 1 there is shown a side view of the nail clipper 100 of the present invention. The present invention 100 uses typical nail clipper construction however the central metal strip 26 has a cutting edge on both ends. The left end of the nail clipper assembly 100 has a matching set of finger nail clipping surfaces 22, 20 and the right end has a matching set of toe nail clipping surfaces 6, 10. Metal strip 8 is welded at one end to central strip 26 as shown at point 34. Strip 8 terminates at its opposite end in cutting edge 6. Metal strip 14 is welded to the bottom surface of central strip 26 as shown at point 16. Vertical post 12 retains the lever arm 2 of toe nail cutting portion. Vertical post 28 retains the lever arm 30 of finger nail cutting portion.

FIG. 2 shows a side view of the nail clippers of the present invention with toe nail cutting lever arm 2 in the use position as found in conventional nail clippers. The user puts his or her thumb on lever 2 at position 40 and puts his or her forefinger on stored lever arm 30. By pressing the two arms 2, 30 together the user can trim his or her toe nails.

FIG. 3 shows a side view of the nail clippers of the present invention with the finger nail cutting lever arm 30 in the use position as found in conventional nail clippers. The user puts his or her thumb at the free end of lever arm 30 and his or her forefinger on stored lever arm 2. By pressing the two arms 2, 30 together the user can trim his or her finger nails.

In this way a person can cut his or her finger nails or toe nail with a single unique, combined toe and finger nail clipper which is more economical to manufacture and more convenient to store and use than two separate toe and finger nail clippers.

Another aspect of the invention is shown in FIGS. 4 and 5. In this aspect the clipper is constructed such that when one of the finger or toe nail cutting configuration is used the other nail clipping surfaces are forced together to be touching or at least very close. Now referring to FIGS. 4 and 5, this is shown in more detail.

The overall configuration is the same as described above. In particular referring to FIG. 4 with the finger nail cutting configuration in use, the lever arm 2, has an extension portion 42 which extends forward of the vertical post 12 and at angle toward the metal strip 8 a greater distance than shown in FIGS. 1, 2 and 3 so as to force the metal strip 8 toward the central strip 26 and consequently the distance between the toe nail clipping surfaces 6, 10 is closed. The length of the extension portion 42 is selected so as to allow the cutting edges 5 and 7 toe nail clipping surfaces 6 and 10 to touch or be only slightly separated. It is not desirable to have them be forced together so much that the cutting edges can be damaged.

Similarly, referring to FIG. 5 with the toe nail cutting configuration in use the lever arm 30 has an extension 32 which extends forward of the vertical post 18 and at an angle toward the metal strip 14 a greater distance than shown in FIGS. 1, 2 and 3 so as to force the metal strip 14 toward the central strip 26 and consequently the distance between the cutting edges 9 and 11 of finger nail clipping surfaces 20, 22 is closed. The length of the extension portion 32 is selected so as to allow the finger nail cutting edges 9 and 11 to touch or be only slightly separated. It is not desirable to have them be forced together so much that the cutting edges can be damaged.

Also, it is common to place the clipper into its in-use configuration by a flipping of the lever arm 2 or 30 over the post 12 or 18 respectively as shown by arrows A and B, respectively and then rotating it around the bias of the post. This can be done by performing these actions in the reverse order. Where the flipping is done the extension portions 42 and 32 respectively will cause the metal strips 8 and 14 to close toward or press against their mating cutting edges 7 and 9 surfaces 10 and 20 respectively. Consequently, it is preferred to leave a slight separation distance between the clipping surfaces when in the not in use position so that upon flipping they will not close with such pressure as to damage the sharp edges. The slight separation distance should not be more than about 0.025 inch and at a minimum not less than about 0.010 inch the most preferred distance being about 0.020 inch.

It is possible to construct the clipper so that only one of the lever arms 40 and 30 has the extension portion, this would cause sacrifice the benefit of keeping the clipping surfaces closed in only slightly separated.

With this structure, in use the end being held will be more comfortable because it is not necessary to take care to avoid the cutting edges, of the clipping surfaces in particular the sharp corner at the end of the clipping surfaces which could be the case if they were left in the open position.

Although particular embodiments of the invention have been described and illustrated herein, it is recognized that modifications and variations may readily occur to those skilled in the art and consequently it is intended that the claims be interpreted to cover such modifications and equivalents.

We claim:

1. An improved nail clipper comprising;

a first metal strip terminating at a first end in an upwardly facing toe nail cutting edge and at a second end in a downwardly facing finger nail cutting edge;

a second metal strip attached to the first metal strip near the finger nail cutting edge and extending above and in alignment with said first metal strip and gradually spaced away from said first metal strip and terminating in a downwardly facing toe nail cutting edge which is mateable with said upwardly facing toe nail cutting edge when biased toward it;

a third metal strip attached to the first metal strip near the toe nail cutting edge and extending below and in alignment with said first metal strip and gradually spaced away from said first metal slip and terminating in an upwardly facing finger nail cutting edge which is mateable with said downwardly facing finger nail cutting edge when biased toward it;

a first vertical shaft extending said toe nail cutting edge upwardly from said first metal strip and through an opening in said second metal strip and terminating in a detent end;

a first lever rotatably retained on said detent end of said first vertical shaft and having a lever arm portion and an opposite extending extension portion extending at an angle toward said second metal strip said extension portion having a length such that when said lever arm portion is in is most collapsed position said extension portion has biased said downwardly facing toe nail cutting edge toward said upwardly facing toe nail cutting edge to a position where they are touching or not more than slightly separated;

a second vertical shaft extending near said finger nail cutting edge downwardly from said first metal strip and through an opening in said third metal strip and terminating in a detent end;

a second lever mateably retained on said detent end of said second vertical shaft and having a lever arm portion and an oppositely extending extension portion extending at an angle toward said third metal strip said extension portion having a length such that when said lever arm is in its most collapsed position, said extension portion has biased said upwardly facing finger nail cutting edge toward said downwardly facing finger nail cutting edge to a position where they are touching or not more than slightly separated.

2. The improved nail clipper of claim 1 wherein said finger nail cutting edges and said toe nail cutting edges are touching or slightly separated to a distance not more than about 0.025 inch.

3. The improved nail clipper of claim 2 wherein said finger nail cutting edges and said toe nail cutting edges are slightly separated a distance from about 0.010 inch to about 0.025 inch.

4. The improved nail clipper of claim 3 wherein said finger nail cutting edges and said toe nail cutting edges are slightly separated a distance of about 0.020 inch.

* * * * *